US011174695B2

(12) United States Patent
Zaragoza Labes et al.

(10) Patent No.: US 11,174,695 B2
(45) Date of Patent: Nov. 16, 2021

(54) INTEGRATED FUNCTION BLOCK FOR USE IN SUBSEA SYSTEMS

(71) Applicant: FMC TECHNOLOGIES DO BRASIL LTDA, Rio de Janeiro (BR)

(72) Inventors: Alan Zaragoza Labes, Rio de Janeiro (BR); Heloisa Helena da Silva Folhadella, Niterói (BR); Jones Jonson Matias Dos Santos, Nova Iguaçu (BR)

(73) Assignee: FMC TECHNOLOGIES DO BRASIL LTDA, Rio de Janeiro (BR)

( * ) Notice: Subject to any disclaimer, the term of this patent is extended or adjusted under 35 U.S.C. 154(b) by 0 days.

(21) Appl. No.: 16/301,194

(22) PCT Filed: May 2, 2017

(86) PCT No.: PCT/BR2017/050104
§ 371 (c)(1),
(2) Date: Nov. 13, 2018

(87) PCT Pub. No.: WO2017/193189
PCT Pub. Date: Nov. 16, 2017

(65) Prior Publication Data

US 2019/0292871 A1 Sep. 26, 2019

(30) Foreign Application Priority Data

May 11, 2016 (BR) ..... BR 1020160106966

(51) Int. Cl.
*E21B 33/035* (2006.01)
*B22F 3/15* (2006.01)
(Continued)

(52) U.S. Cl.
CPC ..... *E21B 33/035* (2013.01); *B22F 3/15* (2013.01); *B22F 5/10* (2013.01); *B22F 7/08* (2013.01)

(58) Field of Classification Search
CPC ..... E21B 33/035; E21B 33/0355
See application file for complete search history.

(56) References Cited

U.S. PATENT DOCUMENTS 5,280,766 A * 1/1994 Mohn ..... E21B 33/076 166/368
6,378,613 B1 * 4/2002 Kent ..... E21B 33/035 166/368
(Continued)

FOREIGN PATENT DOCUMENTS

WO 2008/150177 A1 12/2008
WO 2016/044910 A1 3/2016

OTHER PUBLICATIONS

Written Opinion of the International Searching Authority issued in PCT/BR2017/050104 dated Aug. 22, 2017 (7 pages).
(Continued)

*Primary Examiner* — Matthew R Buck
(74) *Attorney, Agent, or Firm* — Osha Bergman Watanabe & Burton LLP

(57) ABSTRACT

An integrated function metallic block is capable of integrating into a single metal block the functions of valve blocks, block of hydraulic components of the pumping system, channels for transporting produced and separated fluids, flanges for choke connections and sensors, connection fittings and other components capable of being manufactured mutually within a single metallic block. The integrated function block is composed of complex geometry circuits having curves, slants and connections with other channels occurring within the block mass, and is preferably manufactured through the powder metallurgy process of hot isostatic pressing to obtain complex geometries having the lowest possible weight.

8 Claims, 5 Drawing Sheets

(51) Int. Cl.
*B22F 5/10* (2006.01)
*B22F 7/08* (2006.01)

(56) References Cited

U.S. PATENT DOCUMENTS

| | | | | |
|---|---|---|---|---|
| 6,968,902 | B2 * | 11/2005 | Fenton | B01D 17/0211 166/358 |
| 7,520,989 | B2 * | 4/2009 | Ostergaard | B01D 17/00 210/512.1 |
| 8,613,323 | B2 * | 12/2013 | Garbett | E21B 33/038 166/368 |
| 9,169,709 | B2 * | 10/2015 | Vincent | E21B 43/01 |
| 9,702,215 | B1 * | 7/2017 | Murphy | E21B 33/076 |
| 9,765,593 | B2 * | 9/2017 | Ross | E21B 33/047 |
| 2004/0251030 | A1 * | 12/2004 | Appleford | E21B 43/36 166/357 |
| 2009/0183790 | A1 | 7/2009 | Moore | |
| 2009/0277644 | A1 | 11/2009 | McStay et al. | |
| 2013/0098633 | A1 * | 4/2013 | Fenton | E21B 43/0122 166/382 |

OTHER PUBLICATIONS

International Search Report issued in PCT/BR2017/050104 dated Aug. 22, 2017 (3 pages).

* cited by examiner

PRIOR ART

PRIOR ART

INTEGRATED FUNCTION BLOCK FOR USE IN SUBSEA SYSTEMS

FIELD OF THE INVENTION

The present invention relates to new concepts, arrangements and manufacturing types for a metallic block applicable to subsea systems, which integrates within a single body the valve blocks, block of hydraulic components of the pumping system, channels for transporting the produced and separated fluids, flanges for choke connections and sensors, among others.

BACKGROUND OF THE INVENTION

As is well known by those skilled in the art, subsea equipment is generally designed to withstand the severity of the subsea environment, such as high pressure (internal and external), temperature, contact with corrosive agents, etc. Thus, this equipment is designed according to extremely conservative standards, which require high reliability and robustness against potential failures, which leads the final product to have large metallic structures, to the point of weighing up to hundreds of tons. FIGS. 3 and 4 exemplify the order of magnitude of the dimensions and weight of the complete assembly of a subsea system for fluid separation and pumping according to the state of the art. In this example, dimensions are about 29 m×8.5 m×8.5 m, with a self-weight of 400 tons.

Another important limiting factor for the design is represented by the difficulties of the manufacturing process. One example of the manufacturing process commonly used in subsea system designs is the use of forging, pipe sections, beams, plates, billets, bars, among others. The forging product is simple and resembles a rectangular or square base prism, thus requiring further steps in order to be formed, such as pre-machining, coating welding and finishing.

During pre-machining, a variety of tools are used, such as lathes, milling cutters and devices that require the handling and tipping of the block for different tool access, thus giving the block its desired final shape. Coating welding is normally used in regions where sealing is required and at the areas of contact with the produced fluid, and there is a need to limit the torch's reach for solder application and thermal relief, which need to be checked and controlled when they are required. The workpiece may still be returned to the machining table to produce a final finish which is generally performed when the weld-coated surface is to be ground.

The limitation of this prior art manufacturing process involving forging and machining steps is the difficulty of tool access, both externally and internally, making it impossible to manufacture parts with complex structures such as, for example, overlapping curved cavities, thus requiring manufactured parts to be often larger than those required to perform the proposed function.

In general, all limitations of manufacturing processes should be considered so that the feasibility of manufacturing, welding, coating welding application, assembly, painting, thermal insulation application, testing of parts and system integration are ensured for all the items that make up the system.

A subsea fluid separation system is, for example, composed of thousands of items ranging from the most complex to the most relevant to the design, such as everyday items, such as nuts and bolts. However, each of these equipment and components must be specified based on strict international standards governing engineering practices for subsea applications, which obviously directly reflects the cost of the project. FIG. 4 exemplifies such plurality of components in a subsea system for fluid separation and pumping.

Therefore, during the manufacturing, assembling and testing stages of subsea equipment, significant time and resources are consumed, factors which directly affect the final cost of the project. In addition, strict item management is required; so that activities related to warehousing, supplier management, logistics, outsourced services, inventory space, space to accommodate machine tools and other manufacturing devices and other common activities in any project of this size do not adversely affect the progress of the project. Further, in addition to all of these abovementioned factors, there are also indirect costs related to heavy and large equipment, which makes it necessary to use very high capacity transportation for large loads.

The above-described problems and drawbacks for the overall process of manufacturing subsea systems for separation and pumping of fluids have not so far been solved in an objective and less costly, technical way for their production, transportation and installation.

Thus, it is an object of the present invention to provide a novel concept, arrangement and method of manufacturing a metallic block that integrates the functions of valve block, block of hydraulic components of the pumping system, channels for transporting the produced and separated fluids, flanges for choke connections and sensor connections, among others, to reduce manufacturing, assembly, transportation and installation costs in subsea projects used by the oil industry.

BRIEF DESCRIPTION OF THE INVENTION

According to the present invention, a novel concept for subsea installation projects is provided, in which common functions such as valve block and channels for transporting the produced and separated fluids are integrated into a single metallic body. To that end, and due to the complexity of its geometry, said metallic body is produced by the powder metallurgy process of hot isostatic pressing.

The present invention shall be referred to herein as "integrated function metal block".

BRIEF DESCRIPTION OF THE FIGURES

The integrated function metal block according to the present invention may be well understood from the accompanying illustrative figures, which, in a schematic way and not limiting its scope, represent.

DETAILED DESCRIPTION OF THE INVENTION

Figure 1:
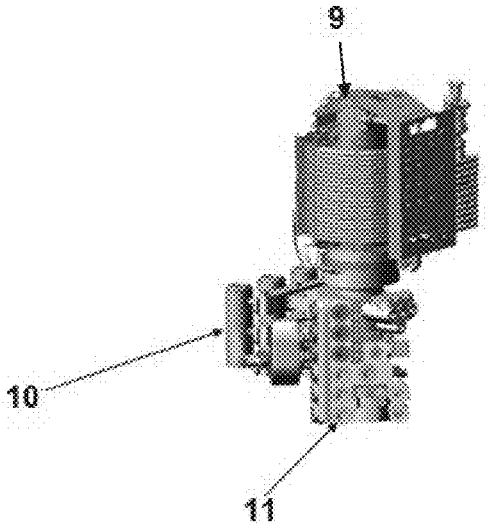
FIG. 1—Integrated function metallic block having integration of valve seats, channels for transporting fluids, subsea pump body and removable hydrocyclones.
Figure 2:
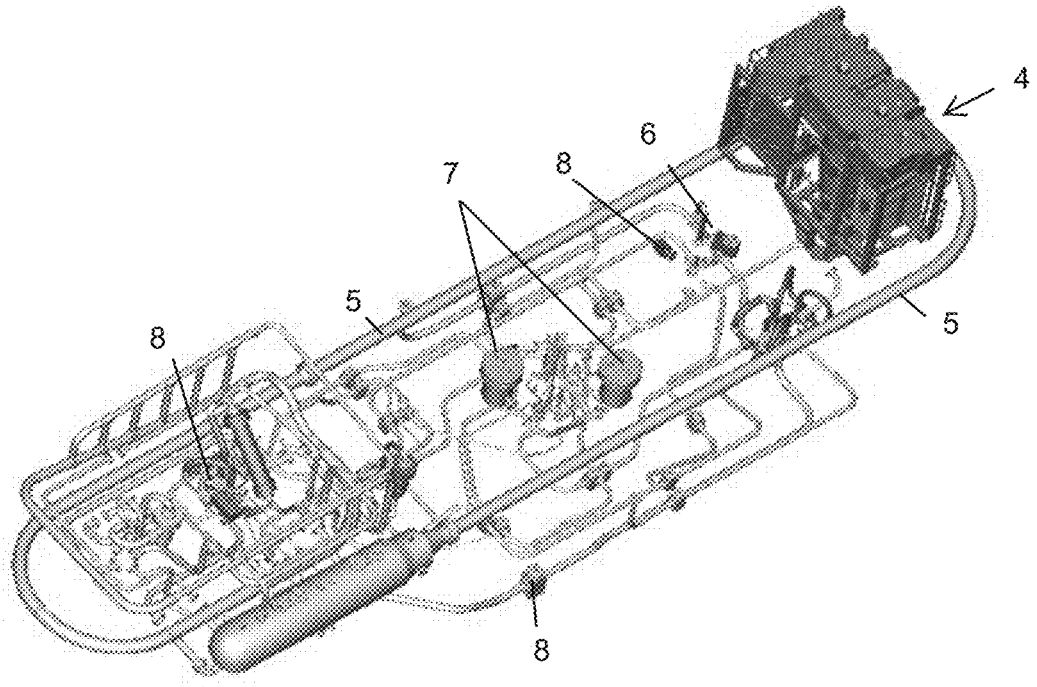
FIG. 2—Subsea system equipment that perform the function of separating oil, gas and sand from water, pumping module and piping for which the system is intended.
Figure 3:
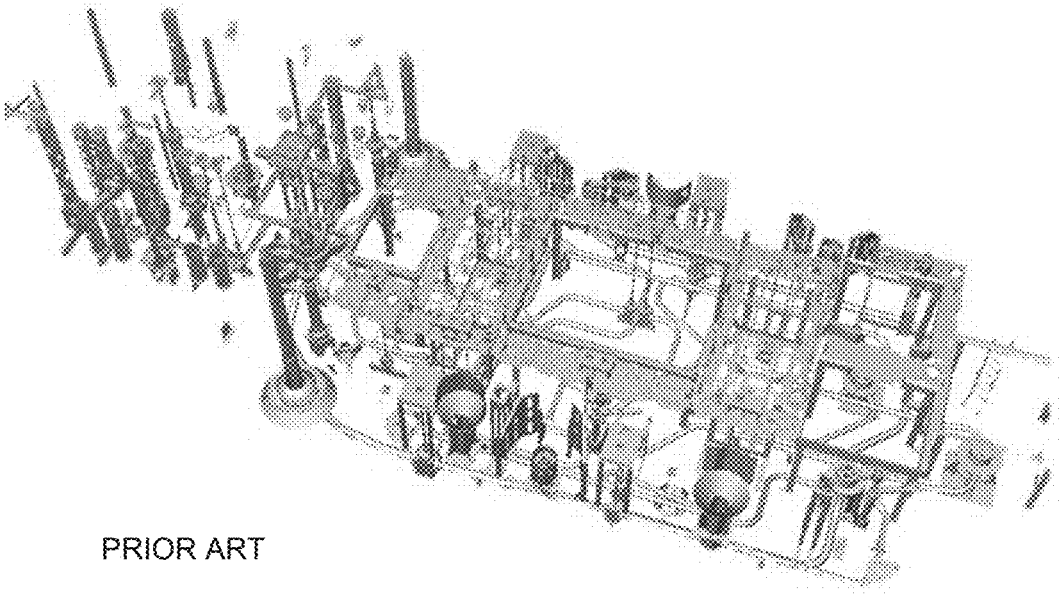
FIG. 3—Supports, accessories, panels, pipes and installation guides for the subsea system shown in FIG. 2.
Figure 4:
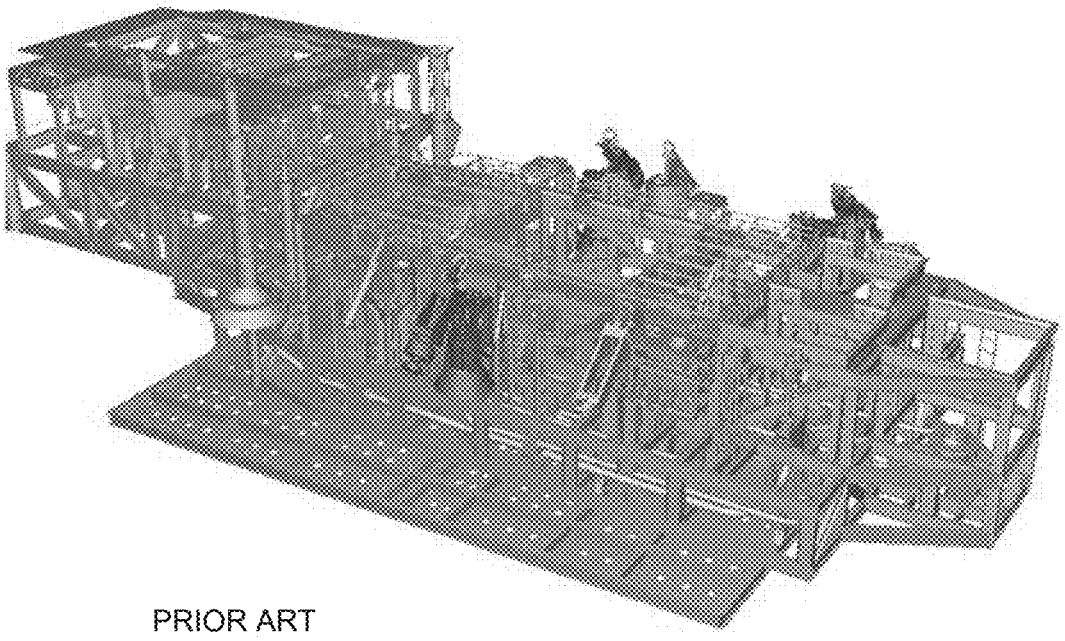
PRIOR ART FIGURE 4
FIG. 4—Structure, piping, connections and accessories for the subsea system shown in FIG. 2.
Figure 5:
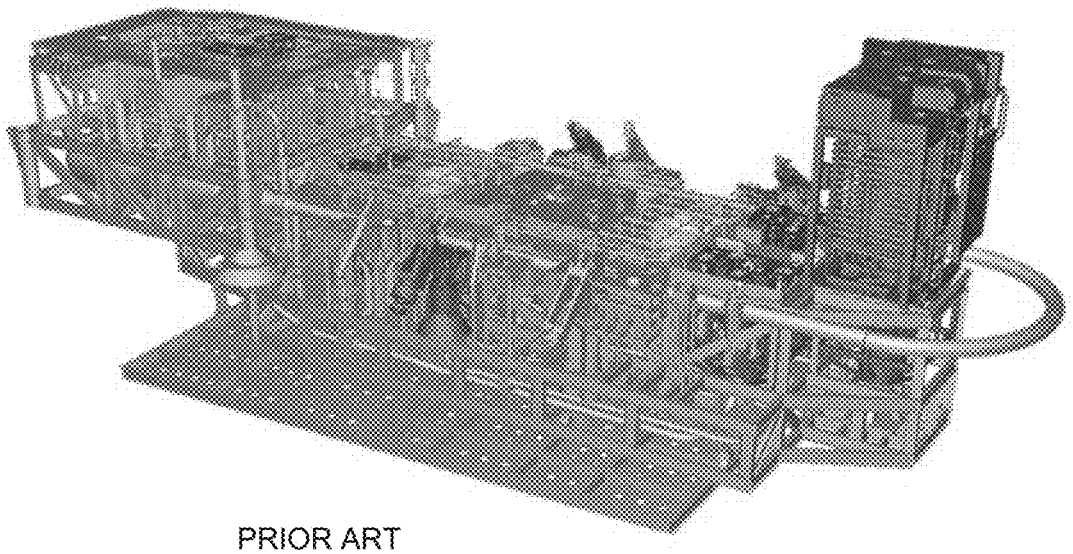
FIG. 5—Complete assembly of a subsea system for separation of fluids and pumping.

In a first aspect, the present invention provides a novel concept of a metallic block, which shall be referred to as an integrated function metal block (1), capable of integrating various functions, such as, valve block, block of hydraulic components of the pumping system, fluid transport channels, flanges for choke connections and sensors, subsea pump body, among others.

As a consequence of such integration, the circuits of the complex geometry internal channels (2) have curves, slants and connections with other channels (3) occurring within the mass of the block (1). For this geometry to be feasible, said integrated function metallic block (1) is manufactured from the hot isostatic pressing (HIP) powder metallurgy process.

The powder metallurgy process must consist of two steps: (i) pressing, wherein the metal powder is shaped, and (ii) sintering, wherein powder particles are joined. However, hot isostatic pressing performs both steps simultaneously, and is generally geared towards parts having larger dimensions and complex geometries such that it would be impossible to manufacture them by adopting conventional processes such as forging and machining. Used for obtaining high performance materials such as hard metal and tool steel, this process consists of placing the metallic powder in capsules, which comprise the external shape of the desired geometry, and are subsequently subjected to high pressure and high temperatures, but below melting temperature, such that process parameters are adjusted in order to ensure densification of the material.

The metal powder at the end of the process takes the form of the filler capsule where it was introduced, and the molded part is then removed by acid etching to be brought to heat treatment in order to relieve residual stresses and improve mechanical properties. After this heat treatment, the part goes through final machining for finishing. The feasibility of making the capsule, for the most part, governs the feasibility of the geometry that may be made through HIP.

It should further be noted that the metallic block capsule allows access to the seat cavities through the top and side, so as to ensure filling of the metal powder in the interstices of cavities by keeping the smallest distance between the cavities above the smallest acceptable distance, thus enabling said final machining of the part. The positioning of the wells is performed so that the manufacturing tolerances are acceptable with regards to their position.

To exemplify the advantages of the integrated function metallic block (1) according to the present invention, a prior art subsea installation is shown in FIGS. 2, 3, 4 and 5, respectively detailing the subsea system equipment which perform the function of separating oil, gas and sand from the water with a pumping module (4), piping for transporting fluids (5), sensors (6), hydrocyclones (7) and valve seats (8), as well as support, accessories, panels, pipes, installation guides, structure, piping, connections and accessories of the subsea system. These components and the full assembly of a prior art fluid separation and pumping subsea system are well understood and mastered by those skilled in the art.

For such application of separation and pumping of fluids in subsea systems, the integrated function metallic block (1) according to the present invention is coupled to a subsea pump (9), removable hydrocyclones (10) and valve seats (11), as shown in FIG. 1. Such configuration in accordance with the present invention, compared with prior art subsea fluid separation systems, does not require the use of approximately 30 valve bodies, about 400 meters in length of fluid transport piping, and shares the components of different functions within a single element, thus eliminating the need for fittings, welds, isolation valves, among others, and significantly reducing the amount of items that make up a subsea fluid separation and pumping system.

Figure 6:
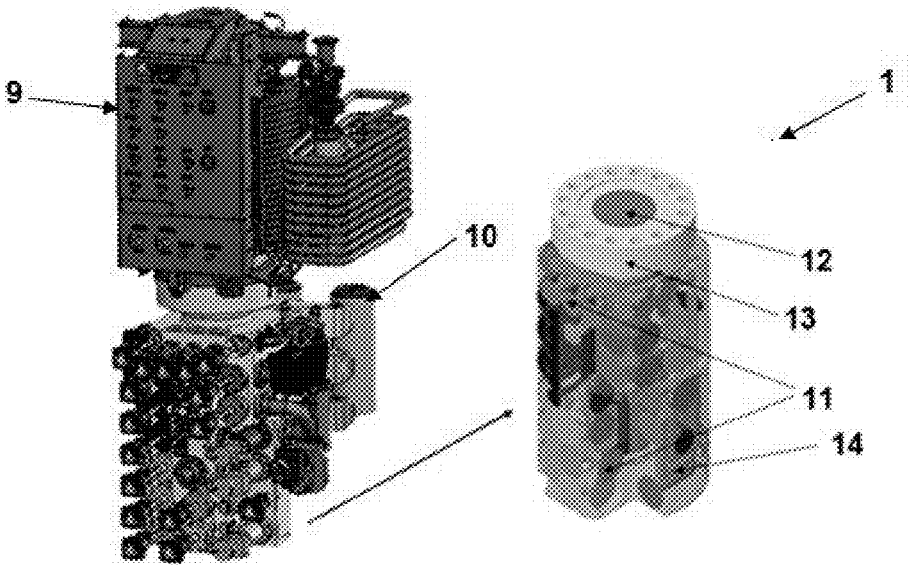
PRIOR ART FIGURE 6
FIG. 6—Detail view of the interior of the integrated function metallic block.
Figure 7:
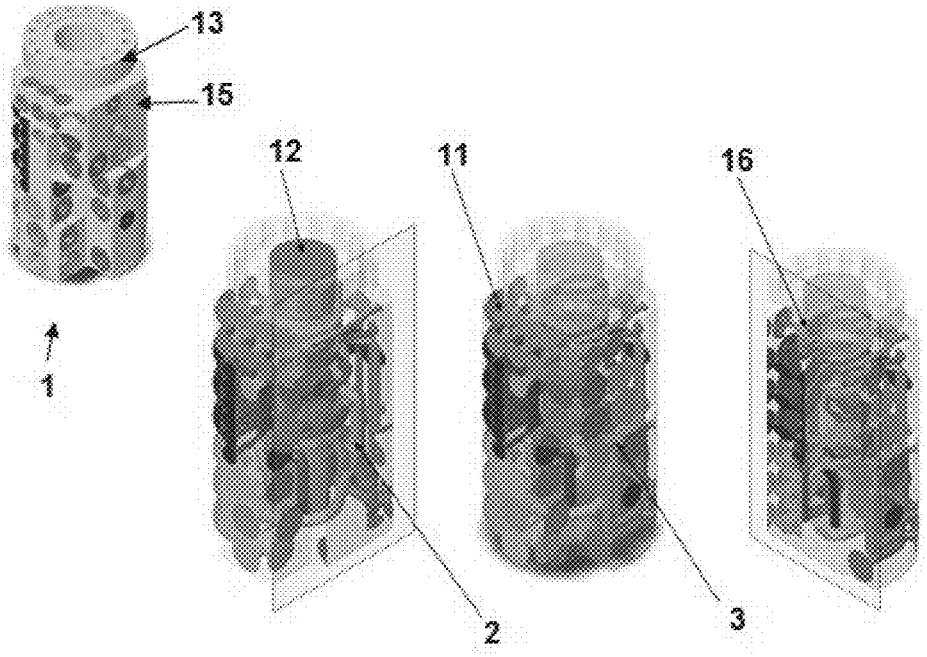
FIG. 7—Visualization of the wells of the valve seats and channels to transport fluids of the integrated function metallic block.

In order to improve the understanding and visualization of the internal components of the integrated function metallic block (1) which is the object of the present invention, in FIGS. 6 and 7, its metallic outer cover (15) is not shown, thus allowing a detailed view of the valve seats (11), the main cavity (12), channel circuits within the interior (2) of the block (1), the connection of the circuits (3) within the block (1), the fluid transport channels (16), the flange (13) and the routing of the tubes (14).

Both the assembly and interconnection of these components are well known to those skilled in the art, as they conform to design and manufacturing standards for such fluid separation and pumping systems in an oil exploration subsea environment.

It should be noted that the integrated function metallic block (1) may be applied to any subsea system in which it is possible to integrate valve blocks, fluid transport channels, connection fittings and other components that may be integrated into a single metallic block. Thus, the integrated function metallic block (1) according to the present invention may be manufactured according to the needs of each project, its arrangement and manufacture being intended to contemplate, in addition to a subsea fluid separation and pumping system flow diagram, also production or injection manifolds, Christmas trees or any other subsea installation, or even at the surface level, which contemplate components that may be integrated in this manner.

It is also important to note that the integrated function metallic block (1) which is the object of the present invention encompasses the alternatives and variations of the powder metallurgy process, and may be made of superduplex metal material, corrosion resistant material such as Inconel 625, or a bimetallic combination enabled by HIP process steps, a combination of metallic materials and composite materials, or only composites. For less demanding applications, i.e. having lower demands or less corrosive environments, it is possible to use less noble materials such as carbon steel, low alloy steel or SS 316. In addition, the integrated function metallic block (1) according to the present invention may further be produced by a melting process combined with the HIP process.

Therefore, among several effects and advantages of the integrated function block according to the present invention, we can highlight the dimensional and weight reduction of the subsea system as a whole, a significant reduction of the number of elements constituting the system, a reduction of steps required for the manufacturing process and consequently the manufacturing time and final delivery to the customer, the feasibility of making complex parts with internal curves within the block by integrating items into a single component, a reduction of moving parts, thus increasing the reliability of the system, and finally a reduction of the total cost of the system, an advantage which is constantly sought by designers and manufacturers of fluid separation and pumping systems for oil exploration subsea environments.

The invention claimed is:

1. An integrated function block, comprising:

a single metallic block body, the single metallic block body comprising:

a plurality of valve seats;

a block of hydraulic components of a pumping system;

a plurality of channels for transporting produced and separated fluids;

a plurality of flanges for choke connections and sensors; and a plurality of connection fittings, wherein the plurality of valve seats, the block of hydraulic components, the plurality of channels, the plurality of flanges, and the plurality of connection fittings are manufactured simultaneously and integrally formed within the single metallic block body; and a pump directly coupled to the single metallic block body via one of the plurality of flanges, the pump fluidly coupled to the plurality of valve seats, the block of hydraulic components of the pumping system, and the plurality of channels for transporting produced and separated fluids.

2. The integrated function block according to claim 1, further comprising complex geometry circuits with curves, slants and connections with other channels within the single metallic block body.

3. The integrated function block according to claim 1, wherein the single metallic block body is manufactured by a powder metallurgy process with hot isostatic pressing to obtain complex geometries having the lowest weight possible.

4. The integrated function block according to claim 1, wherein the single metallic block body is manufactured by a powder metallurgy process combined with a melting process.

5. The integrated function block according to claim 1, wherein the single metallic block body provides access to seat cavities of the plurality of valve seats through a top and side of the single metallic block body, thus enabling the single metallic block body to be machined.

6. The integrated function block according to claim 1, wherein the single metallic block body is made of a stainless steel material, a corrosion-resistant alloy, a nickel-chromium-molybdenum alloy for corrosive environments, or a bimetallic combination.

7. The integrated function block according to claim 1, wherein the single metallic block body is manufactured from carbon steel, low alloy steel or SS316.

8. The integrated function block according to claim 1, further comprising at least one removable hydrocyclone coupled to the single metallic block body.

* * * * *